US005199361A

United States Patent [19]

Robinson

[11] Patent Number: 5,199,361

[45] Date of Patent: Apr. 6, 1993

[54] BEACH SAFETY ANCHOR SECURITY SYSTEM

[76] Inventor: Milton W. Robinson, 459 Woodcrest La., Media, Pa. 19063

[21] Appl. No.: 747,272

[22] Filed: Aug. 19, 1991

[51] Int. Cl.[5] ..... E05G 1/02

[52] U.S. Cl. ..... 109/51; 135/16; 248/551; 109/50

[58] Field of Search ..... 109/50-52, 109/45; 135/16 X; 248/551 X, 553; 52/157

[56] References Cited

U.S. PATENT DOCUMENTS

| | | | |
|---|---|---|---|
| 2,209,504 | 7/1940 | Beiter | 52/157 |
| 2,759,486 | 8/1956 | Pesaturo | 135/16 |
| 3,710,736 | 1/1973 | Biondi et al. | 109/50 |
| 4,164,907 | 8/1979 | Piatscheck et al. | 109/50 |
| 4,258,514 | 3/1981 | St. Clair | 52/157 |
| 4,438,606 | 3/1984 | Chardon et al. | 109/51 |
| 4,454,824 | 6/1984 | Wood | 109/50 |
| 4,664,041 | 5/1987 | Wood | 109/51 |
| 4,756,129 | 7/1988 | Webb | 52/157 |
| 4,803,812 | 2/1989 | Alexander, Sr. | 52/157 |
| 4,832,163 | 5/1989 | Levesque | 135/16 |
| 4,832,304 | 5/1989 | Morgulis | 135/16 |
| 4,850,564 | 7/1989 | Padin | 248/533 |
| 4,884,424 | 12/1989 | Meyer | 70/160 |
| 5,046,699 | 9/1991 | Perreault et al. | 135/16 |
| 5,094,423 | 3/1992 | Almquist et al. | 70/58 |

FOREIGN PATENT DOCUMENTS

| | | | |
|---|---|---|---|
| 3736274 | 4/1988 | Fed. Rep. of Germany | 135/16 |
| 1541756 | 9/1968 | France | 52/157 |
| 449954 | 2/1949 | Italy | 135/16 |
| 392557 | 5/1933 | United Kingdom | 109/51 |
| 1098555 | 3/1966 | United Kingdom | 52/157 |
| 1278557 | 6/1972 | United Kingdom | 135/16 |

*Primary Examiner*—Richard E. Moore
*Assistant Examiner*—D. Boucher
*Attorney, Agent, or Firm*—Kenneth P. Glynn

[57] ABSTRACT

The present invention is a ground anchor security system for securing valuables and other items to the earth where they might otherwise be exposed. It includes an auger-type ground anchor having an elongated shaft with a top end and a bottom end, the anchor having a helical auger plate at its bottom end and having a connector to connect a cross-member at its top end, a container and a cross-member. The cross-member is one which is connectible to the top end of the anchor with the connector, the cross-member having a length which is greater than the largest dimension of the opening in the bottom of the container. The cross-member may be of sufficient length to be grasped manually when connected to the connector for facilitating insertion of the anchor into ground, and the container may be a trunk with a top lid. It may have at least one handle located on a side and at least one set of wheels located at its bottom away from the handle. In one embodiment, at least a portion of the anchor is hollow including at the top end of the anchor, and is adapted to receive a staff of a beach umbrella.

13 Claims, 3 Drawing Sheets

BEACH SAFETY ANCHOR SECURITY SYSTEM

BACKGROUND OF THE INVENTION

1. Field of the Invention

The present invention is directed to a portable ground anchor security system. It is more specifically one which includes anchoring means to secure a container to the earth, e.g. beach sand. It also optionally includes provision for securing other items such as beach umbrellas, pets, etc. and can be used as luggage.

2. Prior Art Statement

There have been numerous attempts over the years to secure beach umbrellas to prevent them from falling, blowing away, or even being stolen. Pointed staves, permanent solid anchors, e.g. cement or sand weighted bases, and buried cross-members have been used. In addition, several designs of auger-type anchors have been developed which are rotated into the ground for security.

U.S. Pat. No. 2,209,504 issued to George Beiter describes an early beach umbrella with an earth anchor which is an auger-type and is permanently secured to the bottom end of the umbrella staff.

Very recently issued U.S. Pat. Nos. 4,756,129; 4,803,812 and 4,850,564 describe anchoring systems for umbrellas, posts and the like utilizing lower segment auger-type sectional anchors. U.S. Pat. No. 4,258,514 to Alfred St. Clair describes anchoring dismountable buildings using a series of auger-type anchors and spike members.

Notwithstanding the prior art, there is no teaching of a security system of the present invention involving the temporary anchoring of a secured storage container.

SUMMARY OF THE INVENTION

The present invention is a temporary ground anchor security system for securing valuables and other items to the earth where they might otherwise be exposed. It includes an auger-type ground anchor having an elongated shaft with a top end and a bottom end, the anchor having a helical auger plate at its bottom end and having connecting means to connect a cross-member at its top end, a container with a hole in the bottom and a cross-member. The cross-member is one which is connectible to the top end of the anchor with the connecting means, the cross-member having a length which is greater than the largest dimension of the opening in the bottom of the container. The cross-member may be of sufficient length to be grasped manually when connected to the connecting means for facilitating insertion of the anchor into ground, and the container may be a trunk with a lockable top lid. The container may also be used as luggage. It may have at least one handle located on a side and at least one set of removable wheels located at its bottom away from the handle. In one embodiment, at least a portion of the anchor is hollow including at the top end of the anchor, and is adapted to receive a staff of a beach umbrella. It may also have a pan weight anchor attached to the container for additional security.

BRIEF DESCRIPTION OF THE DRAWINGS

The present invention is more easily understood when the specification herein is taken in conjunction with the drawings. These drawings, which are appended hereto illustrate the following.

DETAILED DESCRIPTION OF THE PRESENT INVENTION

The present invention involves securing valuables to the ground. Although not exclusively developed for beach use, a primary use would be to secure jewelry, glasses, portable radios, money, wallets, car keys, refreshments, clothing and other valuables while swimming, napping or taking a walk. Alternatively, the present invention security system may be used by fishermen, campers, construction and other outdoor workers, etc.

Another object of the present invention security system is to enable a user to secure the earth anchor in such a way that it could not be removed unless the container which attaches to it is unlocked and opened.

Another object of the present invention is to provide an earth anchor security system which is portable and which requires no special skills.

The present invention security system container necessarily has an opening in its bottom so that it may be placed over an anchor, the anchor secured to the container and the container locked.

The present invention security system also has a pan type weight adapter with a necessary opening in its bottom that lines up with the opening of the bottom of the container. When the pan adapter is rotated 180° and attached to the container where the holes in their bottoms do not line up, then the container can be used as a trunk or shipping container e.g. luggage, and packed with personal belongings that cannot fall out.

Figure 1:
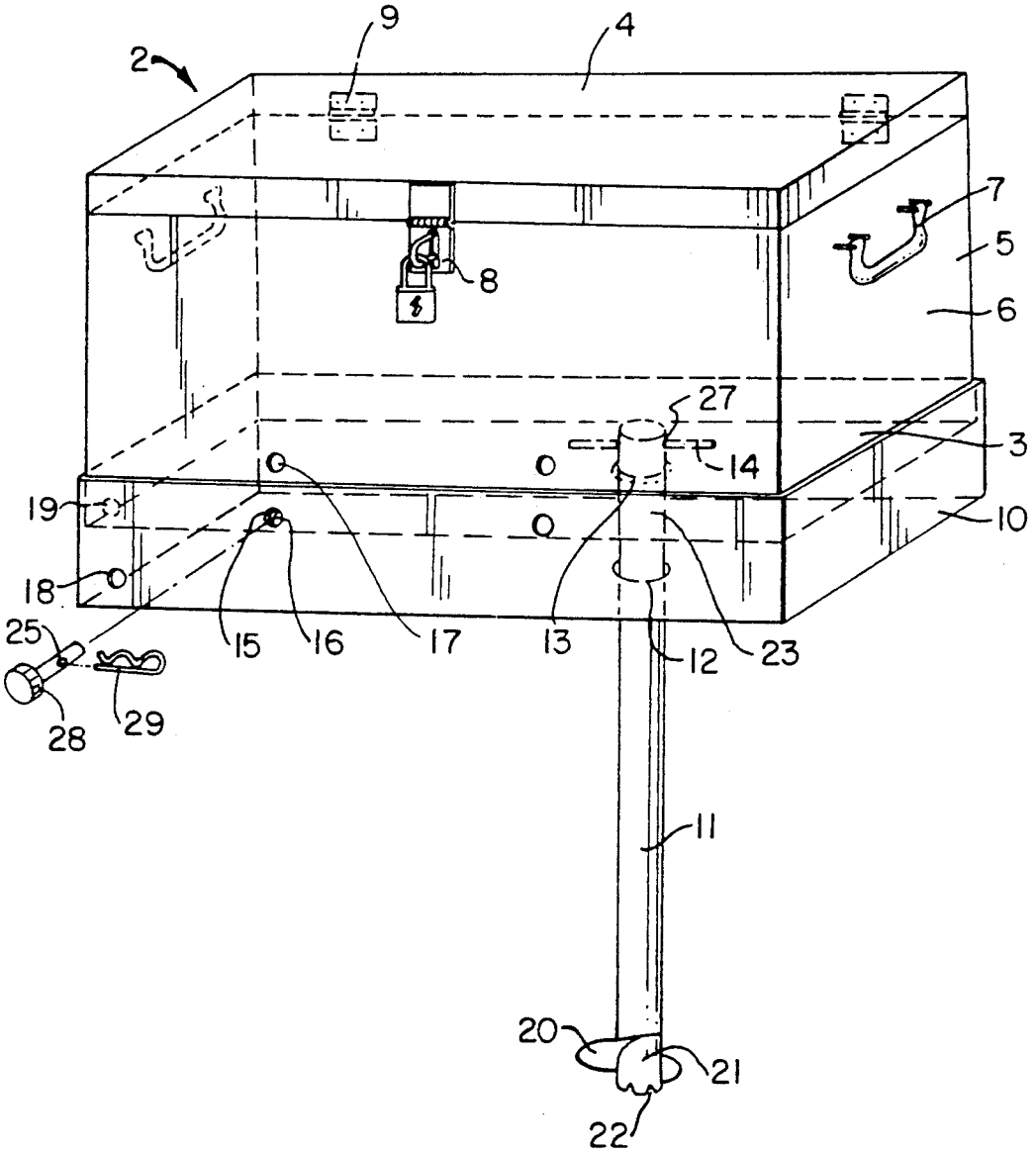
FIG. 1 shows a front oblique view of a present invention security system.

Referring to FIG. 1, a container 2 is made of wood, metal, plastic or any other suitable uninsulated or insulated material usable for securing possessions. It comprises a base 3, a lid 4, and sides 5 extending from the base 3 to the lid 4. The base 3, sides 5 and lid 4 define a square, rectangle, round, oval or any other regular or irregular shaped chamber 6 adapted to receive and secure possessions while on a beach.

Handles 7 are used to lift, move or transport the container 2. The handles 7 may be fixed, adjustable, inlaid, holes, notches or any other type handles suitable for moving, lifting or transporting the container 2. The handles 7 may also be used to help secure the container 2 to the anchor shaft 11 and optional anchor pan 10.

The locking device 8 is designed to protect the contents of chamber 6 by accepting a padlock or any other kind of keyed or combination lock. There may be more than one locking device 8 and they may also be used to secure the anchor shaft 11 and/or anchor pan 10. Hinge 9 is used to help secure the lid 4 to sides 5 and provide a secure pivot point for lid 4 to operate. Hinge 9 may or may not be required to secure lid 4 and may be made of metal, plastic or any other material that can add flexibility and security to join side 5 to lid 4.

Lid 4 or side 5 may or may not also have straps, clips, clamps or devices attached to them for the purpose of attaching, holding or carrying fishing rods, chairs, umbrellas, blankets or any other items desired on the beach.

Also shown in FIG. 1 is anchor pan 10, an optional pan-type anchoring apparatus that may or may not be required to help anchor container 2 to sand. Anchor pan 10 is larger (in this case) than chamber 6 and may be made of metal, wood, plastic, vinyl or any other type material suitable for an anchoring device. Anchor pan 10 could also be made smaller than, or the same size as, chamber 6 with straps or other devices to attach anchor pan 10 to chamber 6. Anchor pan 10 has holes 15 in the sides that will line up with lower holes 16 and upper holes 17. Sides 5 have lower holes 16 and upper holes 17 in them that will line up with holes 15 in anchor pan 10. When anchor pan 10 is all the way up onto container 2, the holes in anchor pan 10 will line up with upper holes 17 located in sides 5. This is the position for transporting container 2 and anchor pan 10 is not being used as an anchor. When anchor pan 10 is in the lower position and being used as a sand anchor, then holes 15 in the anchor pan 10 will line up with lower holes 16 in sides 5, and anchor pan 10 will be partially (in this case) filled with sand.

Locking apparatus pin 28 with pin hole 25 will be inserted through, for example, holes 15 and lower holes 16 or 15 and upper holes 17 depending on whether anchor pan 10 is in the upper or lower position. Pin 28 is inserted from the outside. That will put pin hole 25 which is in pin 28, on the inside of chamber 6. Then locking clip 29 can be inserted into pin hole 25. These locking devices 28 and 29 once inserted will only be removable from inside of chamber 6. Holes 18 in anchor pan 10 are made to line up with holes 19 in sides 5 when the anchor pan 10 is in the closed or all the way up position. Wheels (not shown here) may be mounted in these holes for easy transport. Such wheels and supports may be made of metal, plastic, rubber, or any other material that may be suitable for wheels or shafts. Any type, style or combination of wheels, shafts, axles, bearings, pins, washers, etc., can be mounted on the sides 5, base 3, or anchor pan 10 to help transport container 2. Wheels and their components are desirable but not necessary for container 2 to function.

Anchor shaft 11 is designed to penetrate the sand using a rotary motion to position the anchor end under the sand and making it very difficult to lift out of the sand without using the opposite rotary motion to remove the anchoring device. There may be one, or more than one anchor shaft 11 which include auger-type helical plates 20 at bottom end 21. It may be pipe, tubing, rod, etc., and made of metal, plastic or any other suitable material for anchors. Bottom end 21 (in this case) is hollow and notched, as typefied by notches 22, which aids in cutting through the sand. It also may be closed, solid, pointed or mitered. Anchor shaft 11 is twisted into the sand by inserting cross-member, in this example handle 14, into connecting means (hole) 27 that is in the top end 23 of anchor shaft 11. Using cross member, in this example handle 14, and making a turning motion of anchor shaft 11 provides the impetus to move the bottom end 21 of anchor shaft 11 under the sand. After the anchor shaft 11 is inserted into the sand with the top end 23 sticking up out of the sand, the cross member, in this example handle 14, is removed from the top end 23 of anchor shaft 11. Next, the anchor pan 10 is positioned over the top end 23 of anchor shaft 11 using opening 12 in anchor pan 10. Now anchor pan 10 is partially filled with sand for additional weight. Then the chamber 6 is positioned over top end 23 of anchor shaft 11 using the hole 13 in base 3. Then locking apparatus pin 28 is inserted through holes 15 and lower holes 16 from the outside of chamber 6. Inside chamber 6, locking clip 29 is attached to locking apparatus pin 28, locking it in place. Hole 27 in top end 23 of anchor shaft 11 is now inside chamber 6 and cross member, in this example handle 14, is inserted into hole 27. In this example, hole 27 acts as a connecting means to connect the cross member to the top end of the anchor shaft. Now if chamber 6 is locked using locking device 8, the chamber 6 is secured to anchor pan 10 and anchor shaft 11 and the only way a person could manually release the anchor pan 10 anchor shaft 11 is by entering the now locked chamber 6. Anchor shaft 11 can be installed and removed in the sand manually or with the aid of an externally powered motor or device. Anchor shaft 11 can also be used alone, without container 2, as a device to anchor a beach umbrella, child or pet on a leash. The umbrella shaft would be inserted into the hollow top end 23 of anchor shaft 11 to keep the umbrella from falling over or coming out of the sand when it is windy. The leash could be looped over the top end 23 of anchor shaft 11, then handle 14 could be inserted into hole 27 keeping the leash from coming off.

Container 2 or any of its parts or components may be painted, unpainted, sealed, stained, coated, protected or left in their natural state.

Figure 2:
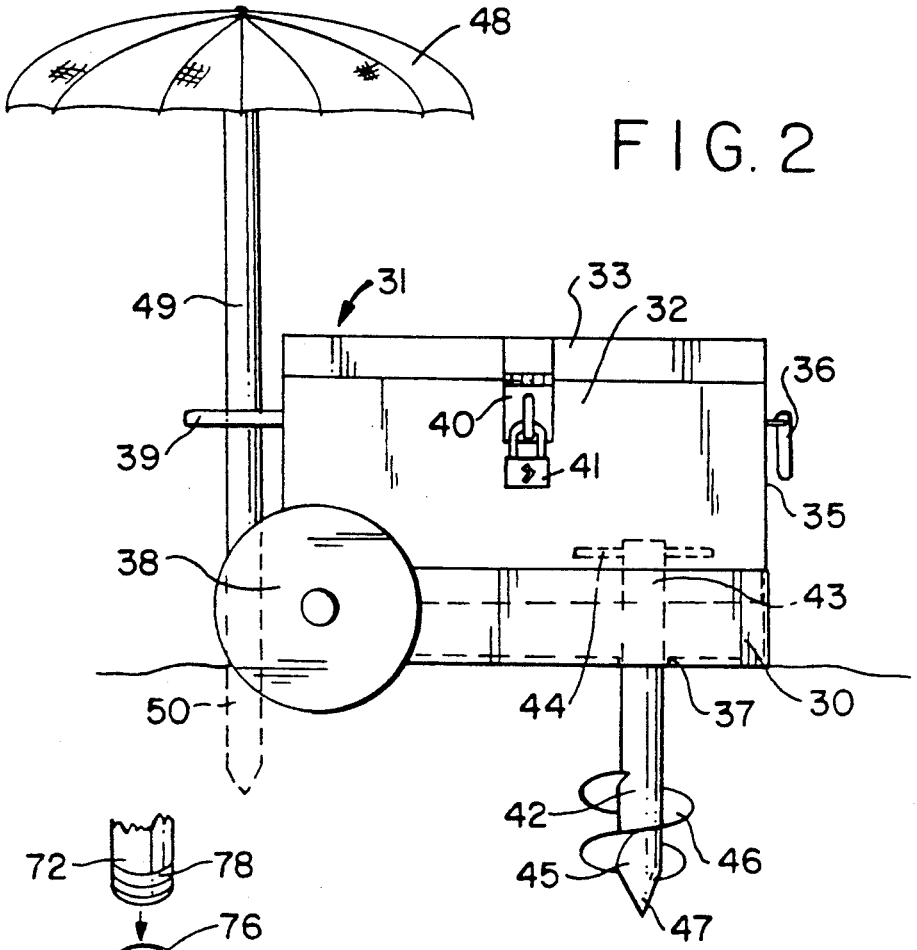
FIG. 2 shows a side view of an alternative present invention security system wherein wheels and an umbrella holder are attached to the container.

FIG. 2 shows a side view of container 31 which has a base 32 and top lid 33, side 35 with handle 36 and latch 40 with lock 41. In this embodiment, two wheels are included for easy transport and are exemplified by removable wheel 38. Container bottom 30 has opening 37 through which anchor shaft 42 may pass. At bottom end 45 of anchor shaft 42 is auger-type helical plates 46 and point 47. A cross-member, in this example handle 44, passes through the top end 43 of anchor shaft 42 and may be operated in a fashion similar to anchor shaft 11 described in FIG. 1 above. The cross-member, here handle 44, has a length greater than the widest dimension of opening 37. Also included is bracket 39 on container 31 which holds umbrella 49 with shaft 50 embedded in sand and umbrella top 48 is opened and placed for shading as desired.

Figure 3:
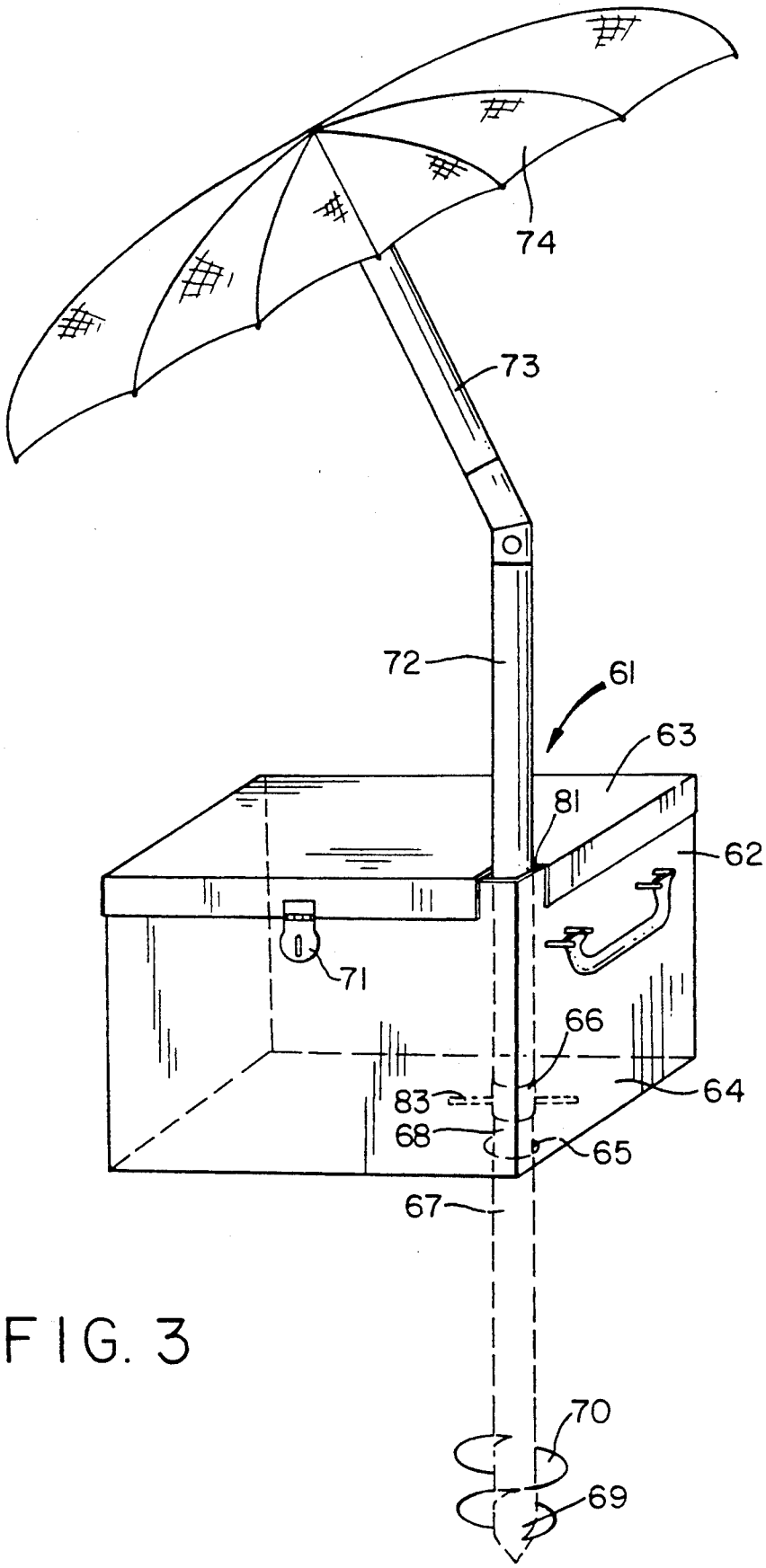
FIG. 3 shows another present invention security system embodiment.

FIG. 3 shows yet another embodiment wherein container 61 has base 62 and lid 63 with locking device 71 and cut-out 81. Container bottom 64 has opening 65 through which anchor shaft 67 may pass. Screw-on cap 66 has a built-in cross-member 83 which extends beyond the diameter of opening 65 and is screwed on to anchor after anchor shaft 67 is screwed into the ground and container 61 has been placed over it. Anchor shaft 67 has auger blade 70 at its lower end 69 and threads (not shown) at its upper end 68. Screw-on cap 66 also has threads in its top (not shown) for receiving a screw in umbrella shaft 72 which passes through cut-out 81 and has angled neck 73 and umbrella top 74. Optionally, an umbrella may be made sectionally so as to break apart or fold down into container 61. Although not a critical feature of the present invention, cut out 81 may also have a hinged closure section that would lock in place when container 61 is being used as a locked storage container or luggage.

Figure 4:
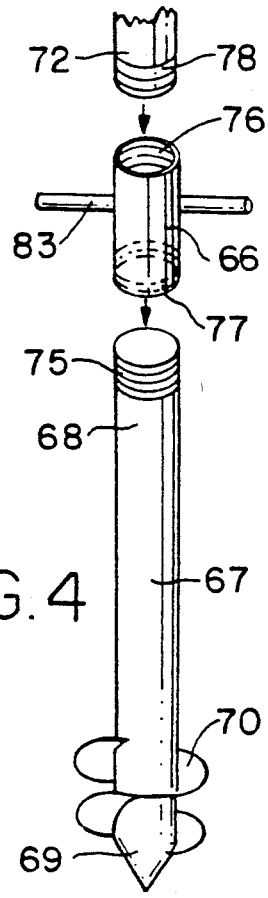
FIG. 4 illustrates a portion of a present invention security system having alternative connecting means; and, FIG. 5 shows an adapter for using motor driven means to rotate the ground anchor in the present invention.

FIG. 4 shows a partial side view of anchor shaft 67 screw-on cap 66 and a bottom portion of umbrella shaft 72, as shown in less detail in FIG. 3. Anchor shaft 67 has auger blade 70 at its lower end 69. Matching threads 75 and 77 are shown respectively on anchor shaft 67 and screw-on cap 66. Also, matching threads 76 and 78 are shown respectively on screw-on cap 66 and umbrella shaft 72.

Figure 5:
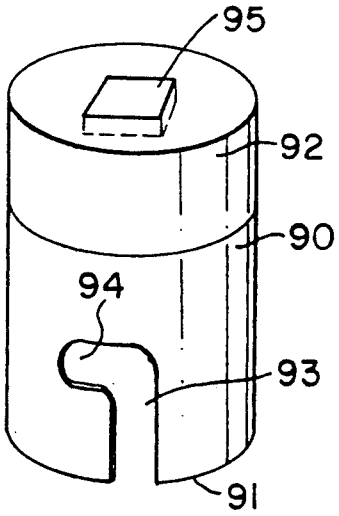

FIG. 5 shows another type of cap 90 which may be used on anchor shaft 11, shown in FIG. 1, to aid in the installation and removal of anchor shaft 11 into and out of the sand. Referring now to both FIGS. 1 and 5, cap 90 would have an outer diameter smaller that the inner diameter of top end 23 of anchor shaft 11. In this case, top end 23 would be hollow, the same as a section of pipe. The bottom end 91 of cap 90 would be inserted into the top end 23 of anchor shaft 11. Cross-member handle 14 would already be installed in top end 23 of anchor shaft 11 using hole 27 (these are shown in FIG. 1). Vertical track 93 and horizontal track 94 are larger than the outside diameter of cross member, in this example handle 14, enabling bottom end 91 to pass handle 14 with handle 14 going up into vertical track 93. Upper portion 92 has a recess 95 adapted to receive a ratchet wrench fitting to assist in turning anchor shaft 11 into or removing anchor shaft 11 from the ground. In this case a clockwise motion is required to drive anchor shaft 11 into the sand. An electrically driven (battery) ratchet adapter is inserted into recess 95. Using a manually applied downward pressure, the ratchet turns cap 90 clockwise. The top end of vertical track 93 exerts turning pressure on handle 14 which in turn drives anchor shaft 11 clockwise and down into the sand. Reversing the ratchet and causing it to be driven counter-clockwise turns cap 90 which causes horizontal track 94 to engage handle 14 at the end of track 94. This exerts counter-clockwise pressure on anchor shaft 11 and causes it to remove itself from the sand. Cap 90 may also be made to fit over top of top end 23. Top 90 may be made from metal, plastic or any other material suitable for caps.

Obviously, numerous modifications and variations of the present invention are possible in light of the above teachings. It is therefore understood that within the scope of the appended claims, the invention may be practiced otherwise than as specifically described herein.

What is claimed is:

1. A ground anchor security system, which comprises:

(a) at least one auger-type ground anchor having an elongated shaft with a top end and a bottom end, said anchor having a helical auger plate extending from the shaft at its bottom end and having connecting means, including a hole, to connect a cross-member at its top end;

(b) a closable, lockable container having sides, a top and a bottom and having an opening located in said bottom of sufficient size to enable the top end of said anchor to pass through said opening and to enter into said container; and, (c) a cross-member which is connectible to the top end of said anchor with said connecting means, by insertion into said hole, said cross-member having a length which is greater than the largest dimension of the opening in the bottom of said container, said cross-member being a rod or pipe, which fits into said hole, said rod being a handle of sufficient length to be grasped manually when connected to said connecting means for facilitating insertion of said anchor into ground and removal of said anchor from ground.

2. The security system of claim 1 wherein said container is a trunk with a lockable top lid.

3. The security system of claim 2 wherein said trunk has at least one handle located on a side and at least one set of removable wheels located at its bottom away from said handle.

4. The security system of claim 1 wherein at least a portion of said anchor is hollow including at the top end of said anchor and is adapted to receive a staff of a beach umbrella.

5. The security system of claim 1 wherein said container is a trunk with a top lid, the opening in the bottom of the trunk is located in a front corner, the top end of the anchor is adapted to receive a staff of a beach umbrella and the lid of the trunk has a cut-out located in a front corner corresponding to the opening in the bottom and of adequate size to permit a staff of a beach umbrella to pass therethrough.

6. The security system of claim 1 wherein said container includes an additional pan weigh anchor with locking means to attach to said container.

7. The security system of claim 1 wherein at least a portion of said anchor is hollow including at the bottom end of said anchor and is notched to assist said anchor in cutting through sand and earth.

8. A ground anchor security system, which comprises:

(a) at least one auger-type ground anchor having an elongated shaft with a top end and a bottom end, said anchor having a helical auger plate extending from its shaft at its bottom end and having connecting means to connect a cross-member at its top end;

(b) a closable, lockable container having sides, a top and a bottom and having an opening located in said bottom of sufficient size to enable the top end of said anchor to pass through said opening and to enter into said container;

(c) a cross-member which is connectible to the top end of said anchor with said connecting means, said cross-member having a length which is greater than the largest dimension of the opening in the bottom of said container; and, (d) a pan weigh anchor with locking means to attach said pan weigh anchor to said container wherein said container has at least one handle located on a side and at least one set of removable wheels located at its bottom away from said handle.

9. The ground anchor security system of claim 8 wherein said container is a trunk with a lockable top lid.

10. The ground anchor security system of claim 8 wherein at least a portion of said anchor is hollow including at the top end of said anchor and is adapted to receive a staff of a beach umbrella.

11. A ground anchor security system, which comprises:

(a) at least one auger-type ground anchor having an elongated shaft with a top end and a bottom end, said anchor having a helical auger plate extending from the shaft at its bottom end and having connecting means to connect a cross-member at its top end, the top end of the shaft of the anchor also being adapted to receive a staff of a beach umbrella;

(b) a closable, lockable container having sides, a top and a bottom and having an opening located in said bottom of sufficient size to enable the top end of said anchor to pass through said opening and to enter into said container, and the top of said container having a cut-out of sufficient size to receive a staff of a beach umbrella;

(c) a cross-member which is connectible to the top end of said anchor with said connecting means, said cross-member having a length which is greater than the largest dimension of the opening in the bottom of said container; and, (d) a beach umbrella including a staff which is passed through the cut-out in the top of said container and further to the top end of said anchor shaft.

12. The security system of claim 11 wherein said container is a trunk with a lockable top lid.

13. The security system of claim 11 wherein said container is a trunk with a top lid, the opening in the bottom of the trunk is located in a front corner, and the lid of the trunk has a cut-out located in a front corner corresponding to the opening in the bottom.

* * * * *